US005697556A

United States Patent [19]

Foster

[11] Patent Number: 5,697,556

[45] Date of Patent: Dec. 16, 1997

[54] LIQUID DISPENSER HAVING DISCHARGE VALVE ASSEMBLY

[75] Inventor: Donald D. Foster, St. Charles, Mo.

[73] Assignee: Contico International, Inc., St. Louis, Mo.

[21] Appl. No.: 575,722

[22] Filed: Dec. 18, 1995

[51] Int. Cl.[6] ..... B05B 9/043; B05B 1/34

[52] U.S. Cl. ..... 239/333; 239/492; 239/493

[58] Field of Search ..... 239/333, 491–493; 222/383.1

[56] References Cited

U.S. PATENT DOCUMENTS

| | | | |
|---|---|---|---|
| 4,519,527 | 5/1985 | Klaeger | 239/333 X |
| 4,678,123 | 7/1987 | Klaeger | 239/493 X |
| 4,826,052 | 5/1989 | Micallef | 239/333 X |
| 5,114,052 | 5/1992 | Tiramani et al. | 239/333 X |
| 5,522,547 | 6/1996 | Dobbs et al. | 239/333 |

FOREIGN PATENT DOCUMENTS

| | | | |
|---|---|---|---|
| 117898 | 9/1984 | European Pat. Off. | 239/333 |
| 202380 | 11/1986 | European Pat. Off. | 239/333 |
| 92/04128 | 3/1992 | WIPO . | |
| 94/13408 | 6/1994 | WIPO . | |
| 96/12671 | 5/1996 | WIPO . | |

*Primary Examiner*—Lesley D. Morris
*Attorney, Agent, or Firm*—Howell & Haferkamp, L.C.

[57] ABSTRACT

A liquid dispenser comprising a dispenser body and a valve housing. The dispenser body has a pump mechanism, an intake port adapted for fluid communication with a source of liquid, and an intake liquid flow path providing fluid communication between the intake port and the pump mechanism. The dispenser body further comprises a discharge conduit and a discharge liquid flow path providing fluid communication between the pump mechanism and discharge conduit. The discharge conduit has a downstream end through which dispensed liquid exits the discharge conduit. The valve housing has first and second portions, a fluid passageway within the first and second portions, and a discharge port in the second portion and in fluid communication with the fluid passageway. The first portion of the valve housing is attached to the dispenser body adjacent the downstream end of the discharge conduit so that the passageway of the valve housing is in fluid communication with the discharge conduit. The liquid dispenser further includes a check valve positioned in the passageway of the valve housing. The check valve is moveable between a closed position for blocking fluid flow between the pump mechanism and discharge port and an open position for permitting fluid flow.

29 Claims, 2 Drawing Sheets

LIQUID DISPENSER HAVING DISCHARGE VALVE ASSEMBLY

BACKGROUND OF THE INVENTION

This invention relates to a liquid dispenser and more particularly to a pump-type dispenser.

A pressure buildup sprayer is a general type of sprayer in which liquid dispensed from the sprayer is raised to a certain pressure level before it is dispensed from the sprayer. Typically, such a sprayer includes a dispenser body having a manually operated pump which draws liquid from a source of liquid (e.g., a container) and dispenses it through a nozzle via a liquid flow path in the dispenser body. A pressure regulating valve (e.g., a pressure buildup valve) within the liquid flow path and downstream of the pump prevents the flow of liquid to the nozzle until the liquid is raised to at least a minimum fluid pressure level. When the fluid pressure reaches the minimum level, the pressure regulating valve opens to permit liquid to be dispensed through the pressure regulating valve and out the nozzle. The pressure regulating valve typically has a moveable member within the dispenser body which is moveable in and out of seating engagement with a valve seat formed in the dispenser body. Such pressure regulating valve also has a spring for urging the moveable member toward the valve seat.

A disadvantage of such a sprayer is that the dispenser body must be shaped to accommodate the pressure regulating valve and generally must be formed with components of the valve, such as a valve seat. Forming a valve body to have some of the parts of the valve is often difficult and expensive and requires the use of complex molding techniques. It is also difficult to assemble the various parts of the valve in the dispenser body.

Moreover, in prior art sprayers, the dispenser body is either configured for accommodating only a pressure buildup check valve or a regular check valve. Thus, different dispenser body types must be made to accommodate both types of sprayers.

SUMMARY OF THE INVENTION

Among the several objects of the present invention may be noted the provision of an improved dispenser; the provision of such a dispenser having a dispenser body of relatively simple construction; the provision of such a dispenser having a dispenser body configured for accommodating different types of check valves; the provision of such a dispenser having a dispenser body of a shape which may be manufactured relatively easily; the provision of such a dispenser which is relatively easy to assemble; the provision of such a dispenser having a check valve in which all of the parts of the check valve are separate from the dispenser body; and the provision of such a dispenser having a valve housing separate from the dispenser body.

In general, a liquid dispenser of the present invention comprises a dispenser body and a valve housing. The dispenser body has a pump mechanism, an intake port adapted for fluid communication with a source of liquid, an intake liquid flow path providing fluid communication between the intake port and the pump mechanism, and a first check valve in the intake liquid flow path. The first check valve is configured for permitting fluid flow from the intake port to the pump mechanism and for checking fluid flow from the pump mechanism to the intake port. The dispenser body further comprises a discharge conduit and a discharge liquid flow path providing fluid communication between the pump mechanism and discharge conduit. The discharge conduit has a downstream end through which dispensed liquid exits the discharge conduit.

The valve housing has first and second portions, a fluid passageway within the first and second portions, and a discharge port in the second portion and in fluid communication with the fluid passageway. The first portion of the valve housing is attached to the dispenser body adjacent the downstream end of the discharge conduit so that the passageway of the valve housing is in fluid communication with the discharge conduit.

The liquid dispenser further includes a second check valve positioned in the passageway of the valve housing. The second check valve is moveable between a closed position for blocking fluid flow between the pump mechanism and discharge port and an open position for permitting fluid to flow from the pump chamber through the discharge port via the discharge liquid flow path and the fluid passageway of the valve housing.

In another aspect of the present invention, the liquid dispenser is a trigger sprayer.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
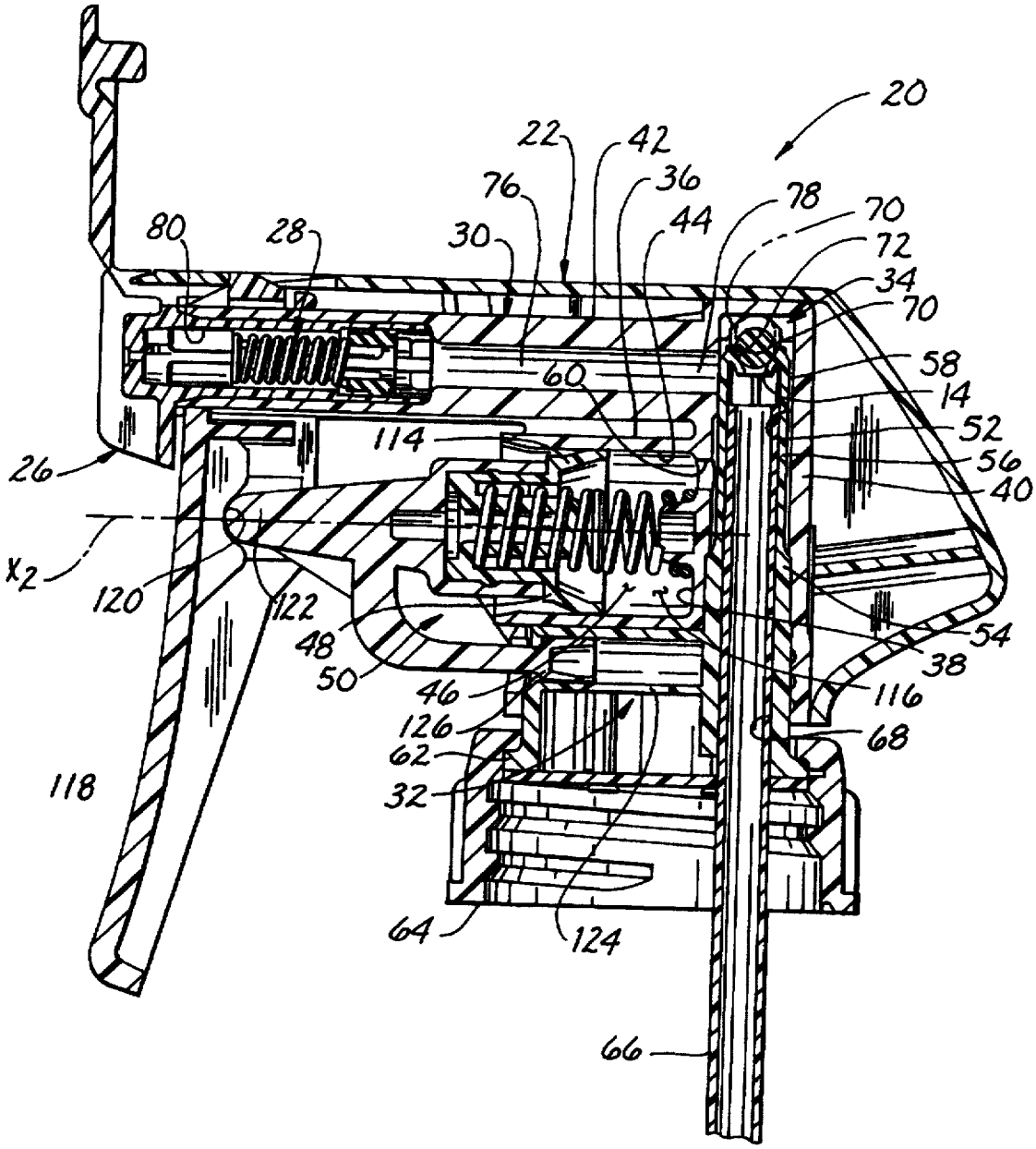
FIG. 1 is a side elevational view, in section, of a liquid dispenser of the present invention having a dispenser body and a valve housing inserted in the dispenser body.

Referring now to the drawings, and first more particularly to FIG. 1, a spray-type dispenser of the present invention is indicated in its entirety by the reference numeral 20. The dispenser 20 comprises a dispenser body, generally indicated at 22, a valve housing, generally indicated at 26, and a pressure regulating valve (i.e., pressure buildup valve), generally indicated at 28. The dispenser body 22 comprises an upper housing member, generally indicated at 30, a lower housing member, generally indicated at 32, and a ball-type check valve, generally indicated at 34. Preferably, each of these components is of a polymeric material. However, it is to be understood that some or all of the components may be of other materials without departing from the scope of this invention.

The upper housing member 30 of the dispenser body 22 includes a cylindric formation (wall) 36, a disc-shaped back wall 38 substantially closing one end (i.e., the right end as viewed in FIG. 1) of the cylindric wall, a generally cylindric vertical formation 40 adjacent the disc-shaped back wall, and a horizontal tubular portion 42 extending forward from the vertical formation. The cylindric wall 36 includes a generally cylindric inner surface 44. The inner surface 44 of the cylindric wall 36 and the disc-shaped back wall 38 define a pump chamber 46 open at one end (i.e., its left end as viewed in FIG. 1) for slidably receiving a pump piston 48. The pump chamber 46 and pump piston 48 constitute a pump mechanism 50 of the dispenser body 22.

The vertical formation 40 of the upper housing member 30 has a vertical bore 52 extending upward from the bottom of the vertical formation 40. A lower end of the vertical bore 52 receives the lower housing member 32 of the dispenser body 22. More particularly, the lower housing member 32 has a generally cylindric column 54 extending upward into the vertical bore 52 in sealing engagement with the vertical formation 40. Preferably, an upper end portion 56 of the cylindric column 54 is of reduced diameter to define a cylindric gap 58 between the cylindric column and the surface of the vertical bore 52. The cylindric gap 58 is in fluid communication with the pump chamber 46 via a lateral opening 60 through the disc-shaped back wall 38 of the upper housing member 30. The lower housing member 32 also has an annular flange 62.

Preferably a threaded collar 64 (or cap) is retained on the lower housing member 32 via the annular flange 62 for receiving a threaded neck of a liquid bottle (not shown). A dip tube 66 is sealingly press fit into a cylindric inner surface 68 of the cylindric column 54 and depends therefrom. The dip tube 66 is adapted to extend downward into liquid (not shown) within the bottle. The dip tube 66 constitutes a conduit for transporting liquid from the bottle upward into the dispenser body 22. Although the dispenser 20 preferably has a generally straight dip tube extending down into a bottle, it is to be understood that a long flexible tube could alternatively extend from the lower housing member 32 to a source of liquid remote from the sprayer.

The check valve 34 comprises a ball 70, an annular valve seat 72 formed at the upper end of the cylindric column 54, and an opening 74 defined by the valve seat. The ball 70 of the check valve 34 is moveable between an open position (shown in phantom in FIG. 1) and a closed position (shown in solid in FIG. 1). In its open position, the ball 70 is spaced above the valve seat 72 to permit liquid to flow upward through the dip tube 66 and around the ball, and then downward into the pump chamber 46 via the cylindric gap 58 and lateral opening 60. The cylindric gap 58 and lateral opening 60 constitute an intake liquid flow path and the opening 74 constitutes an intake port (also indicated at 74) for the intake liquid flow path. In its closed position, the ball 70 seals against the valve seat 72 to plug the intake port 74 and thereby check fluid flow from the pump chamber 46 to the intake port 74.

The horizontal tubular portion 42 of the upper housing member 30 includes a horizontal discharge conduit 76 extending axially therethrough and in fluid communication with the cylindric gap 58. As described in greater detail below, liquid is pumped by the pump piston 48 out of the pump chamber 46 and through the discharge conduit 76 (from right to left as viewed in FIG. 1) via the lateral opening 60 and cylindric gap 58. The lateral opening 60 and cylindric gap 58 constitute a discharge liquid flow path providing fluid communication between the pump mechanism 50 and discharge conduit 76. The discharge conduit 76 includes an upstream portion 78 and a downstream portion (or end) 80 which is downstream of (i.e., forward of) the upstream portion. Preferably, the diameter of the downstream portion 80 is larger than that of the upstream portion 78 for receiving the valve housing 26.

The valve housing 26 (FIGS. 2 and 3) has a rearward (first) portion 82, a forward (second) portion 84, a fluid passageway 86 within the rearward and forward portions, and a discharge port (nozzle orifice) 88 in the forward portion and in fluid communication with the fluid passageway. Preferably, the forward portion 84 of the valve housing 26 is cylindrical and is sized and configured for a snug friction fit within the downstream portion 80 of the discharge conduit 76 and for preventing leakage between the valve housing and the horizontal tubular portion 42. Liquid flowing forward through the discharge conduit 76 flows through the fluid passageway 86 and is dispensed through the discharge port 88.

Figure 2:
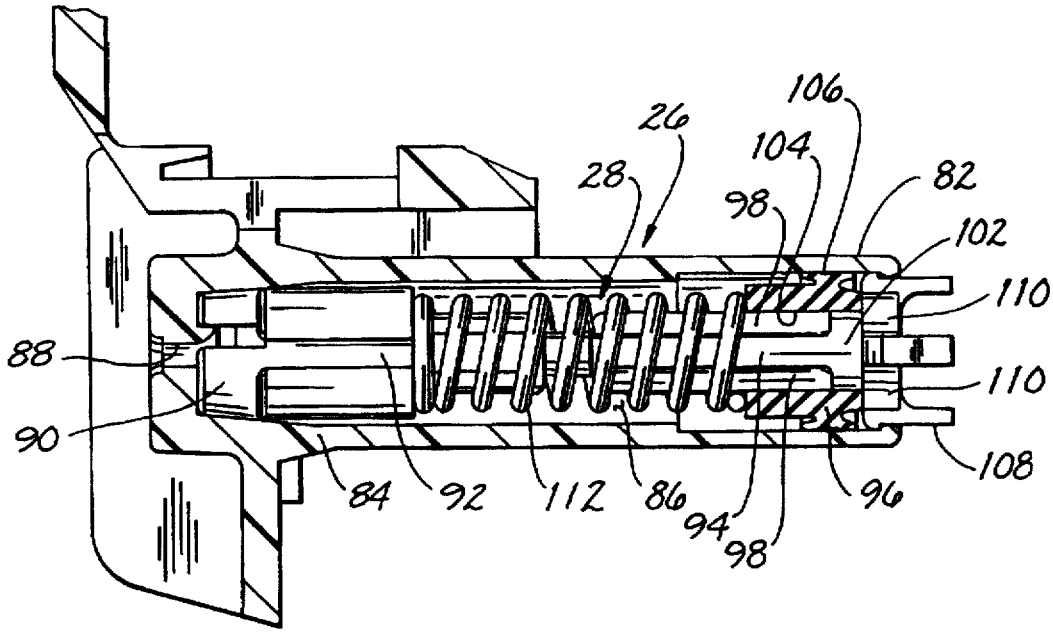
FIG. 2 is an enlarged side elevational view, in section, of the valve housing of FIG. 1 separated from the dispenser body and showing a moveable valve member of a pressure buildup valve in a closed (seated) position.
Figure 3:
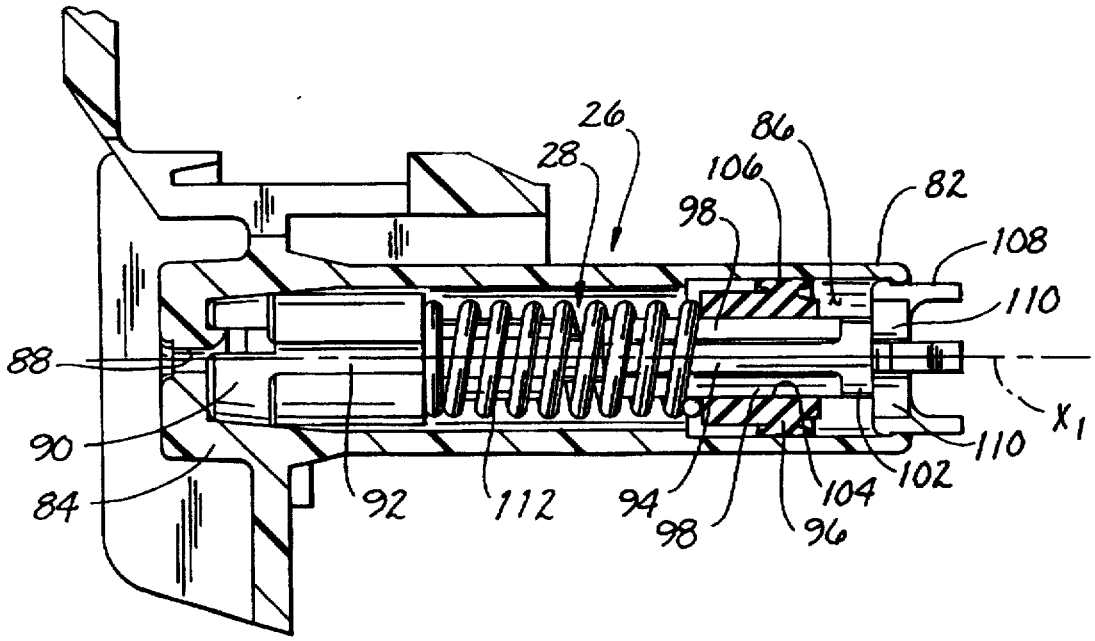
FIG. 3 is an enlarged side elevational view similar to the view of FIG. 2 except showing the valve member in an open (unseated) position.

The valve housing 26 houses a spinner member 90 and the pressure buildup valve 28. The spinner member 90 is positioned in a forward region of the fluid passageway 86 to impart a swirl to liquid flowing forward through the fluid passageway 86 to dispense the liquid from the discharge port 88 in a spray pattern. It includes two channels 92 extending generally axially along its outer surface, and a swirl chamber (not shown) which may be configured and arranged in any conventional manner for spinning the liquid before it is dispensed. The pressure buildup valve 28 comprises a shaft 94 extending rearwardly from the spinner member 90 along an axis $X_1$, and a generally annular valve member 96 slidably mounted on the shaft. Preferably, the shaft 94 is X-shaped in vertical cross section (i.e., in a cross-section taken through a plane perpendicular to the axis $X_1$) to define four liquid-transporting channels 98 (only two of which are shown in FIGS. 1 and 2). A disc-shaped valve seat 102 is at the rearward end of the shaft 94. The annular valve member 96 has a generally cylindric inner surface 104 that slides over the shaft 94. An exterior surface 106 of the annular valve member 96 is in sliding engagement with the cylindrical inner surface of the fluid passageway 86 and is configured for preventing leakage between the exterior surface of the valve member and the valve housing 26. Preferably, a stop 108 is press fit into the rear end of the valve housing for preventing axial movement of the shaft 94 and the spinner member 90 relative to the valve housing 26 and for limiting rearward movement of the annular valve member 96. The stop 108 is generally X-shaped in vertical cross-section to define four openings 110 (only two of which are shown in FIGS. 1 and 2) for providing fluid communication between the discharge conduit 76 and the pressure buildup valve 28. The annular valve member 96 is moveable between a closed position (FIG. 2) and an open position (FIG. 3). In the closed position, inner surface 104 of the valve member 96 engages the stop 108 and seats around the valve seat 102 to prevent liquid from flowing through the fluid passageway 86. In other words, when the pressure buildup valve 28 is closed, the valve member 96 sealingly engages the valve seat 102 to block liquid flow between the pump chamber 46 and discharge port 88. In the open (unseated) position, the annular valve member 96 is forward of and spaced from the valve seat 102 to permit liquid to flow along the liquid-transporting channels 98 and through the inner surface 104 of the valve member 96.

The pressure buildup valve 28 also includes a biasing spring 112 for urging the valve member 96 to its closed position. The biasing spring 112 is preferably a compressed coil spring surrounding the shaft 94 and extending between the spinner member 90 and a forward end of the valve member 96. However, it is to be understood that other types of resilient members and/or arrangements could be employed without departing from the scope of this invention.

As described above, the valve housing 26 and the upper housing member 30 of the dispenser body 22 are separate pieces which are connected together. The upper housing member 30 does not form any component of the pressure buildup valve 28 (e.g., it does not have a formation which acts as a valve seat). Thus, a mold for making the upper housing member 30 can be of a relatively simple construction, and the manufacturing process need not employ complex molding techniques. Also, the components of the pressure buildup valve 28 and the spinner member 90 are preferably assembled in the valve housing 26 before the rearward portion 82 of the valve housing is inserted into the downstream portion 80 of the discharge conduit 76. Thus, assembly of the dispenser is simplified. Further, because the upper housing member 30 may be formed independent of any spinner considerations, pressure buildup considerations, or spray pattern considerations, various types of dispensers and sprayers may be made from a single upper housing member design. In other words, different sizes of nozzle orifices, and different types of spinner members and pressure buildup valves may be assembled and then inserted into a single type of upper housing member.

To dispense viscous liquids (e.g., cooking oils having a viscosity of 20–30 cps) in a spray pattern, it is necessary that the liquid in the discharge liquid flow path be pressurized to at least a minimum fluid pressure level P. This minimum pressure level will vary depending on the viscosity of the liquid and the discharge pattern of spray or stream desired. If the liquid is not so pressurized, the liquid will exit the discharge port 86 only as a thin stream, if it is discharged at all. Because of this, the biasing spring 112 of the pressure buildup valve 28 preferably has a spring constant sufficient to maintain the valve member 96 of the pressure buildup valve in its closed position when fluid pressure in the fluid receiving cavity 116 is below the minimum fluid pressure level P.

The pump piston 48 has a piston head 114 preferably formed of a suitable resilient material such as low density polyethylene. The piston head 114 comprises the rearward end (the right most end as viewed in FIG. 1) of the pump piston 48. The piston head 114 is slidable within the pump chamber 46 and configured for sealing engagement with the cylindric inner surface 44 of the pump chamber 46 all around the piston head 114 to seal against leakage of fluid between the pump piston 48 and cylindric inner surface 44. The piston head 114 and pump chamber 46 define a variable volume fluid receiving cavity 116. The pump piston 48 is reciprocally slidable in the pump chamber 46 generally along an axis $X_2$ between a first (extended) position and a second (compressed) position. When the pump piston 48 is in its extended position (shown in FIG. 1), the fluid receiving cavity 116 has a first (extended) volume. When the pump piston 48 is in its compressed position (not shown), the fluid receiving cavity 116 has a second (compressed) volume which is smaller than the extended volume. Preferably, the inner surface 44 of the pump chamber 46 is configured for venting air between the pump chamber and pump piston 48 in the manner disclosed in commonly-assigned U.S. patent application Ser. No. 08/534,720 (filed Sep. 27, 1995), incorporated herein by reference.

Preferably, the pump piston 48 is moved from its extended position to its compressed position by a trigger 118. The trigger 118 is connected at its upper end (not shown) to the upper housing member 30 for pivotal movement relative to the upper housing member (i.e., clockwise and counterclockwise movement as viewed in FIG. 1). The trigger 118 has a camming surface 120 engageable with a forward end 122 (i.e., the left most end as viewed in FIG. 1) of the pump piston 48. Counterclockwise movement of the trigger 118 causes the camming surface 120 to push against the pump piston 48 and thereby move the pump piston rearwardly (i.e., from left to right as viewed in FIG. 1). A helical piston spring is positioned between the disc-shaped back wall 38 of the pump chamber 46 and the pump piston 48 for urging the pump piston forward to its extended position. Thus, the pump piston 48 is rearwardly moved from its extended position to its compressed position by manually squeezing the trigger 118, and is automatically returned to its extended position via the piston spring when the operator releases the trigger. After the pump has been primed, i.e., after air has been vented from the fluid receiving cavity 116, forward movement of the pump piston 48 along its axis $X_2$ creates vacuum pressure (i.e., negative pressure) in the fluid receiving cavity 116. This vacuum pressure causes liquid to be drawn from the bottle into the fluid receiving cavity 116 via the dip tube 66, intake port 74, and intake liquid flow path. Rearward movement of the pump piston 48 increases the pressure in the fluid receiving cavity 116. This increase in fluid pressure closes the check valve 34, opens the pressure buildup valve 28, and forces liquid out the discharge port 86 via the discharge liquid flow path, discharge conduit 76, and fluid passageway 86.

Preferably, a bottle vent opening 124 is in the lower housing member 32 for opening the top of the bottle to atmosphere. A plug 126 (FIG. 1) is integrally connected to the pump piston 48 and moveable therewith. The plug 126 is adapted for closing the bottle vent opening 124 when the dispenser 20 is not in use to prevent liquid from spilling out of the bottle via the opening.

In operation, the operator squeezes the trigger 118 to move the pump piston 48 rearward to its compressed position (not shown), and then releases the trigger to allow the piston spring to move the pump piston 48 forward to its extended position. This forward movement of the pump piston 48 creates a vacuum pressure in the fluid receiving cavity 116 which moves the ball 70 of the check valve 34 up away from the valve seat 72 and draws liquid from the bottle into the fluid receiving cavity via the dip tube 66 and intake liquid flow path. Subsequent rearward movement of the pump piston 48 pressurizes the liquid. When the pressure of the liquid exceeds the minimum pressure P, then the pressurized liquid unseats the valve member 96 of the pressure buildup valve 28 to open the pressure buildup valve and permit pressurized delivery of the liquid through the discharge port 86. Because the liquid is dispensed through the discharge port 86 at a pressure of at least the minimum fluid pressure level P, the liquid will be dispensed in a desired spray pattern.

Although the pump mechanism 50 of the dispenser 20 is described as having a reciprocating pump piston, it is to be understood that other types of pump mechanisms may be employed without departing from the scope of this invention.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A liquid dispenser comprising:

a dispenser body having a pump mechanism, an intake port adapted for fluid communication with a source of liquid, an intake liquid flow path providing fluid communication between the intake port and the pump mechanism, a first check valve in the intake liquid flow path configured for permitting fluid flow from the intake port to the pump mechanism and for checking fluid flow from the pump mechanism to the intake port, a discharge conduit, and a discharge liquid flow path providing fluid communication between the pump mechanism and discharge conduit, the discharge conduit having a downstream end through which dispensed liquid exits the discharge conduit;

a valve housing having first and second portions, a fluid passageway within the first and second portions, and a discharge port in the second portion and in fluid communication with the fluid passageway, one of the first and second portions of the valve housing including a valve seat, the first portion of the valve housing being attached to the dispenser body adjacent the downstream end of the discharge conduit so that the passageway of the valve housing is in fluid communication with the discharge conduit, the first portion of the valve housing being directly connected to the second portion of the valve housing;

a second check valve in the passageway of the valve housing, the second check valve comprising a moveable valve member and a resilient member, said valve member being linearly moveable along a first axis $X_1$, between a seated position in which the moveable member seats against the valve seat to block fluid flow between the pump mechanism and discharge port and an unseated position in which the moveable member is unseated from the valve seat to permit fluid to flow from the pump chamber through the discharge port via the discharge liquid flow path and the fluid passageway of the valve housing, the resilient member being positioned and configured for applying a biasing force to the valve member for urging the valve member to its seated position;

the valve housing being configured for retaining the moveable valve member and the resilient member within the valve housing independent of the attachment of the valve housing to the dispenser body to thereby facilitate assembly of the second check valve within the valve housing prior to attachment of the valve housing to the dispenser body.

2. A liquid dispenser as set forth in claim 1 wherein the valve housing comprises at least two parts securely fastened together independent of the attachment of the valve housing to the dispenser body to retain the moveable valve member and the resilient member within valve housing.

3. A liquid dispenser as set forth in claim 2 wherein one of the at least two parts of the valve housing is press fit into an opening of another of the parts.

4. A liquid dispenser as set forth in claim 3 wherein said one of the parts comprises a stop engageable with the moveable valve member when the moveable valve member is in its seated position, said moveable valve member being spaced from the stop when in its unseated position.

5. A liquid dispenser as set forth in claim 1 wherein said pump mechanism is spaced from the first axis $X_1$.

6. A liquid dispenser as set forth in claim 5 wherein the pump mechanism includes a pump piston configured for reciprocating movement along a second axis $X_2$ different from the first axis $X_1$.

7. A liquid dispenser as set forth in claim 1 wherein the second check valve is a pressure regulating valve that moves to its open position in response to the pump mechanism increasing a pressure of liquid in the fluid passageway of the valve housing above a minimum pressure.

8. A liquid dispenser as set forth in claim 1 wherein said first portion of the valve housing is positioned generally within the discharge conduit of the dispenser body.

9. A liquid dispenser as set forth in claim 1 wherein the first portion of the valve housing and the discharge conduit are sized and configured for a friction fit of the first portion within the conduit.

10. A liquid dispenser as set forth in claim 9 wherein the first portion of the valve housing has a generally cylindric outer surface.

11. A liquid dispenser as set forth in claim 1 wherein the pump mechanism includes a pump piston configured for reciprocating movement along a second axis $X_2$ different from the first axis.

12. A liquid dispenser as set forth in claim 1 further comprising a trigger operatively connected to the pump mechanism for manually reciprocating at least a part of the pump mechanism.

13. A liquid dispenser as set forth in claim 1 wherein the liquid dispenser is a trigger sprayer.

14. A liquid dispenser as set forth in claim 1 wherein the second portion of the valve housing is configured for atomizing liquid dispensed through the discharge port of the valve housing.

15. A liquid dispenser as set forth in claim 1 further comprising a spinner member within the valve housing for imparting a swirl to liquid flowing forward through the fluid passageway.

16. A liquid dispenser as set forth in claim 1 wherein the valve housing further includes a shaft extending along the first axis $X_1$ for guiding the moveable member of the second check valve as the moveable member is moved between its seated and unseated position.

17. A liquid dispenser as set forth in claim 16 wherein the moveable member of the second check valve circumscribes the shaft of the valve housing.

18. A liquid dispenser as set forth in claim 1 wherein at least part of the first portion of the valve housing and at least part of the second portion of the valve housing constitute a single unitary piece.

19. A trigger sprayer comprising:

a dispenser body having a pump mechanism, an intake port adapted for fluid communication with a source of liquid, an intake liquid flow path providing fluid communication between the intake port and the pump mechanism, a discharge conduit, and a discharge liquid flow path providing fluid communication between the pump mechanism and discharge conduit, the discharge conduit having a downstream end through which dispensed liquid exits the discharge conduit;

a valve housing having first and second portions, a fluid passageway within the first and second portions, and a discharge port in the second portion and in fluid communication with the fluid passageway, one of the first and second portions of the valve housing including a valve seat, the first portion of the valve housing being attached to the dispenser body adjacent the downstream end of the discharge conduit so that the passageway of the valve housing is in fluid communication with the discharge conduit, the first portion of the valve housing being directly connected to the second portion of the valve housing;

a check valve in the passageway of the valve housing, the check valve comprising a moveable valve member, said valve member being moveable between a seated position in which the moveable member seats against the valve seat to block fluid flow between the pump mechanism and discharge port and an unseated position in which the moveable member is unseated from the valve seat to permit fluid to flow from the pump chamber through the discharge port via the discharge liquid flow path and the fluid passageway of the valve housing;

the valve housing being configured for retaining the moveable valve member within the valve housing independent of the attachment of the valve housing to the dispenser body to thereby facilitate assembly of the check valve within the valve housing prior to attachment of the valve housing to the dispenser body.

20. A trigger sprayer as set forth in claim 19 wherein the second portion of the valve housing is configured for atomizing liquid dispensed through the discharge port of the valve housing.

21. A trigger sprayer as set forth in claim 19 wherein the dispenser body further comprises a check valve in the intake liquid flow path configured for permitting fluid flow from the intake port to the pump mechanism and for checking fluid flow from the pump mechanism to the intake port.

22. A trigger sprayer as set forth in claim 19 further comprising a spinner member within the valve housing for imparting a swirl to liquid flowing forward through the fluid passageway.

23. A trigger sprayer as set forth in claim 19 wherein the check valve further comprises a coil spring for biasing the valve member against the valve seat.

24. A trigger sprayer as set forth in claim 19 wherein the valve member of the check valve is moveable along a first axis $X_1$, said pump mechanism being spaced from the first axis $X_1$.

25. A trigger sprayer as set forth in claim 24 wherein the pump mechanism includes a pump piston configured for reciprocating movement along a second axis $X_2$ different from the first axis $X_1$.

26. A liquid dispenser comprising:

a dispenser body having a pump mechanism, an intake port adapted for fluid communication with a source of liquid, an intake liquid flow path providing fluid communication between the intake port and the pump mechanism, a first check valve in the intake liquid flow path configured for permitting fluid flow from the intake port to the pump mechanism and for checking fluid flow from the pump mechanism to the intake port, a discharge conduit, and a discharge liquid flow path providing fluid communication between the pump mechanism and discharge conduit, the discharge conduit having a downstream end through which dispensed liquid exits the discharge conduit;

a valve housing having first and second portions, a fluid passageway within the first and second portions, and a discharge port in the second portion and in fluid communication with the fluid passageway, one of the first and second portions of the valve housing including a valve seat, the first portion of the valve housing being attached to the dispenser body adjacent the downstream end of the discharge conduit so that the passageway of the valve housing is in fluid communication with the discharge conduit;

a second check valve in the passageway of the valve housing, the second check valve comprising a moveable valve member and a resilient member, said valve member being linearly moveable along a first axis $X_1$, between a seated position in which the moveable member seats against the valve seat to block fluid flow between the pump mechanism and discharge port and an unseated position in which the moveable member is unseated from the valve seat to permit fluid to flow from the pump chamber through the discharge port via the discharge liquid flow path and the fluid passageway of the valve housing, the resilient member being positioned and configured for applying a biasing force to the valve member for urging the valve member to its seated position;

the valve housing further including a shaft extending along the first axis $X_1$ for guiding the moveable member of the second check valve as the moveable member is moved between its seated and unseated position, the moveable member of the second check valve circumscribing the shaft of the valve housing;

the valve housing being configured for retaining the moveable valve member and the resilient member within the valve housing independent of the attachment of the valve housing to the dispenser body to thereby facilitate assembly of the second check valve within the valve housing prior to attachment of the valve housing to the dispenser body.

27. A liquid dispenser as set forth in claim 26 wherein the shaft of the valve housing includes an axial channel for passage of fluid through the moveable member of the second check valve when the moveable member is in its unseated position.

28. A method of making a liquid dispenser comprising the steps of:

forming a dispenser body having a pump mechanism, an intake port adapted for fluid communication with a source of liquid, an intake liquid flow path providing fluid communication between the intake port and the pump mechanism, a discharge conduit, and a discharge liquid flow path providing fluid communication between the pump mechanism and discharge conduit, the discharge conduit having a downstream end through which dispensed liquid exits the discharge conduit;

forming a valve housing having first and second portions, a fluid passageway within the first and second portions, the valve housing having an intake end in fluid communication with the fluid passageway, the intake end being configured to direct fluid flow from the discharge conduit of the dispenser to the fluid passageway, the second portion of the valve housing having a discharge port in fluid communication with the fluid passageway, the first portion of the valve housing including a valve seat and being directly connected to the second portion of the valve housing;

inserting a moveable valve member into the fluid passageway of the valve housing so that the moveable valve member is moveable between a seated position in which the moveable member seats against the valve seat to block fluid flow between the intake end and discharge port and an unseated position in which the moveable member is unseated from the valve seat to permit fluid to flow from the intake end through the discharge port via the fluid passageway;

retaining the moveable valve member in the valve housing; and attaching the valve housing to the dispenser body adjacent the downstream end of the discharge conduit so that the passageway of the valve housing is in fluid communication with the discharge conduit;

the step of retaining the moveable valve member in the valve housing being independent of the step of attaching the valve housing to the dispenser body.

29. A liquid dispenser comprising:

a dispenser body having a pump mechanism, an intake port adapted for fluid communication with a source of liquid, an intake liquid flow path providing fluid communication between the intake port and the pump mechanism, a first check valve in the intake liquid flow path configured for permitting fluid flow from the intake port to the pump mechanism and for checking fluid flow from the pump mechanism to the intake port, a discharge conduit, and a discharge liquid flow path providing fluid communication between the pump mechanism and discharge conduit, the discharge conduit having a downstream end through which dispensed liquid exits the discharge conduit;

a valve housing having first and second portions, a fluid passageway within the first and second portions, and a discharge port in the second portion and in fluid communication with the fluid passageway, one of the first and second portions of the valve housing including a valve seat, the first portion of the valve housing being attached to the dispenser body adjacent the downstream end of the discharge conduit so that the passageway of the valve housing is in fluid communication with the discharge conduit, the fluid passageway being configured to direct a primary path of fluid flow from the first portion of the valve housing to the discharge port;

a second check valve in the passageway of the valve housing, the second check valve comprising a moveable valve member and a resilient member, said valve member being linearly moveable along a first axis $X_1$, between a seated position in which the moveable member seats against the valve seat to block fluid flow between the pump mechanism and discharge port and an unseated position in which the moveable member is unseated from the valve seat to permit fluid to flow from the pump chamber through the discharge port via the discharge liquid flow path and the fluid passageway of the valve housing, the resilient member being positioned and configured for applying a biasing force to the valve member for urging the valve member to its seated position, the resilient member being in the primary path of fluid flow;

the valve housing being configured for retaining the moveable valve member and the resilient member within the valve housing independent of the attachment of the valve housing to the dispenser body to thereby facilitate assembly of the second check valve within the valve housing prior to attachment of the valve housing to the dispenser body.

* * * * *